US012349812B2

(12) United States Patent
Yuan

(10) Patent No.: US 12,349,812 B2
(45) Date of Patent: Jul. 8, 2025

(54) FOLDABLE CHILD CARRIER

(71) Applicant: WONDERLAND SWITZERLAND AG, Steinhausen (CH)

(72) Inventor: Jialiang Yuan, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 327 days.

(21) Appl. No.: 17/786,292

(22) PCT Filed: Dec. 7, 2020

(86) PCT No.: PCT/EP2020/084825

§ 371 (c)(1),
(2) Date: Jun. 16, 2022

(87) PCT Pub. No.: WO2021/122088

PCT Pub. Date: Jun. 24, 2021

(65) Prior Publication Data

US 2023/0057379 A1 Feb. 23, 2023

(30) Foreign Application Priority Data

Dec. 18, 2019 (CN) ..... 201911310604.5

(51) Int. Cl.
*A47D 13/02* (2006.01)
*A47D 9/00* (2006.01)

(52) U.S. Cl.
CPC ..... *A47D 13/02* (2013.01); *A47D 9/005* (2013.01); *A47D 9/016* (2022.08); *A47D 13/027* (2022.08)

(58) Field of Classification Search
CPC ..... A47D 13/02; A47D 9/005; A47D 9/016; A47D 13/027; A47D 13/10; A47D 9/00;
(Continued)

(56) References Cited

U.S. PATENT DOCUMENTS

2005/0034232 A1 2/2005 Martin
2008/0224515 A1 9/2008 Cui
2019/0335917 A1 11/2019 Taylor

FOREIGN PATENT DOCUMENTS

CN 2877469 Y * 3/2007 ..... B62B 7/08
CN 106490883 A * 3/2017 ..... A47D 13/02
(Continued)

OTHER PUBLICATIONS

International Search Report mailed in corresponding International Patent Application No. PCT/EP2020/084825 on Dec. 7, 2020, consisting of 3 pp.

(Continued)

*Primary Examiner* — Madison Emanski
(74) *Attorney, Agent, or Firm* — Volpe Koenig

(57) ABSTRACT

A foldable child carrier (200) includes a lateral support (204), an upper frame (202), a lower plate (203) and a folding mechanism (100). The lateral support (204) is connected to and located between a lower plate (203) and an upper frame (202). The lateral support (204) includes a first supporting component (2041) and a second supporting component (2042) movably connected to the first supporting component (2041). The lateral support (204) is folded or unfolded by a relative movement of the first supporting component (2041) and the second supporting component (2042). The folding mechanism (100) includes a driven component (10), a locking component (30) and an operating component (20). The operating component (20) is linked to the driven component (10) and can drive the driven component (10) to engage with the locking component (30) for allowing the relative movement of the first supporting component (2041) and the second supporting component (2042) or to disengage from the locking component (30) for restraining the relative movement of the first supporting
(Continued)

component (2041) and the second supporting component (2042).

19 Claims, 7 Drawing Sheets

(58) Field of Classification Search
CPC ..... A47D 13/06; A47D 13/063; A47D 1/002; A47D 1/006; A47D 1/10; A47D 1/008; A47D 1/0081; A47D 1/023; A47D 11/005; A47D 15/00; A47D 15/001; A47D 7/00; A47D 7/002; A47D 7/005; A47D 7/04; A47D 9/02; A47D 9/057; B62B 7/10; A61G 7/1026; A61G 7/1021; A61G 7/1028; A61G 1/01; A61G 7/05769; A61G 7/001
USPC ..... 5/714, 81.1 R, 487, 499, 706, 709, 5/81.1 HS, 81.1 T
See application file for complete search history.

(56) References Cited

FOREIGN PATENT DOCUMENTS

| | | | |
|---|---|---|---|
| CN | 209202565 | U | 8/2019 |
| CN | 110448099 | A | 11/2019 |
| CN | 209712304 | U | 12/2019 |
| GB | 2575340 | A | 1/2020 |
| JP | 2008154752 | A | 7/2008 |
| JP | 2018501939 | A | 1/2018 |
| KR | 200270844 | Y1 | 3/2002 |
| KR | 101986205 | B1 | 5/2019 |

OTHER PUBLICATIONS

Written Opinion mailed in corresponding International Patent Application No. PCT/EP2020/084825 on Dec. 7, 2020, consisting of 5 pp.

* cited by examiner

FOLDABLE CHILD CARRIER

CROSS REFERENCE TO RELATED APPLICATIONS

This application is a 371 U.S. National Phase of International Application No. PCT/EP2020/084825, filed on Dec. 7, 2020, which claims priority to Chinese Patent Application No. 201911310604.5, filed Dec. 18, 2019, which are incorporated by reference as if fully set forth.

FIELD OF THE APPLICATION

The present application relates to a foldable child carrier according to the pre-characterizing clause of claim 1.

BACKGROUND OF THE APPLICATION

With advancement of society, development of economy and improvement of technology, there are various consumer products in the market for improving material living conditions to promote qualities of people's lives. Child carriers are one of the various consumer products. Parents, who have children, may use different child carriers, such as child bassinets, child baskets, child cradles, child strollers, to carry their children instead of holding the children with their hands according to different demands for reducing burdens when going out.

Currently, in order to ensure safety of use of child carriers, most child carriers, especially child bassinets or child baskets, have fixed supporting structures which cannot be detached or folded. However, such child carriers are too bulky to transport and store. The child carriers not only need to meet requirements of comfort and safety, but also need to achieve purposes of easy transportation and storage. Therefore, there is a need to provide an improved foldable child carrier for solving the aforementioned problems.

SUMMARY OF THE APPLICATION

The present application aims at providing a foldable child carrier.

This is achieved by a foldable child carrier according to claim 1. The dependent claims pertain to corresponding further developments and improvements.

As will be seen more clearly from the detail description following below, the claimed foldable child carrier includes a lateral support, an upper frame, a lower plate and a folding mechanism. The lateral support is connected to and located between the lower plate and the upper frame. The lateral support includes a first supporting component and a second supporting component movably connected to the first supporting component. The lateral support is folded or unfolded by a relative movement of the first supporting component and the second supporting component. The folding mechanism includes a driven component, a locking component and an operating component. The locking component is configured to engage with or disengage from the driven component. The operating component is linked to the driven component. The operating component drives the driven component to engage with the locking component for allowing the relative movement of the first supporting component and the second supporting component or drives the driven component to disengage from the locking component for restraining the relative movement of the first supporting component and the second supporting component.

BRIEF DESCRIPTION OF THE DRAWINGS

In the following, the application is further illustrated by way of example, taking reference to the accompanying drawings. Thereof

DETAILED DESCRIPTION

In order to illustrate technical specifications and structural features as well as achieved purposes and effects of the present application, relevant embodiments and figures are described as follows.

In the following detailed description of the preferred embodiments, reference is made to the accompanying drawings which form a part hereof, and in which is shown by way of illustration specific embodiments in which the application may be practiced. In this regard, directional terminology, such as "top", "bottom", "front", "back", etc., is used with reference to the orientation of the Figure(s) being described. The components of the present application can be positioned in a number of different orientations. As such, the directional terminology is used for purposes of illustration and is in no way limiting. Accordingly, the drawings and descriptions will be regarded as illustrative in nature and not as restrictive. Also, the term "connect" or "link" is intended to mean either an indirect or direct mechanical connection. Thus, if a first device is connected or linked to a second device, that connection may be through a direct mechanical connection, or through an indirect mechanical connection via other devices and connections.

Figure 1:
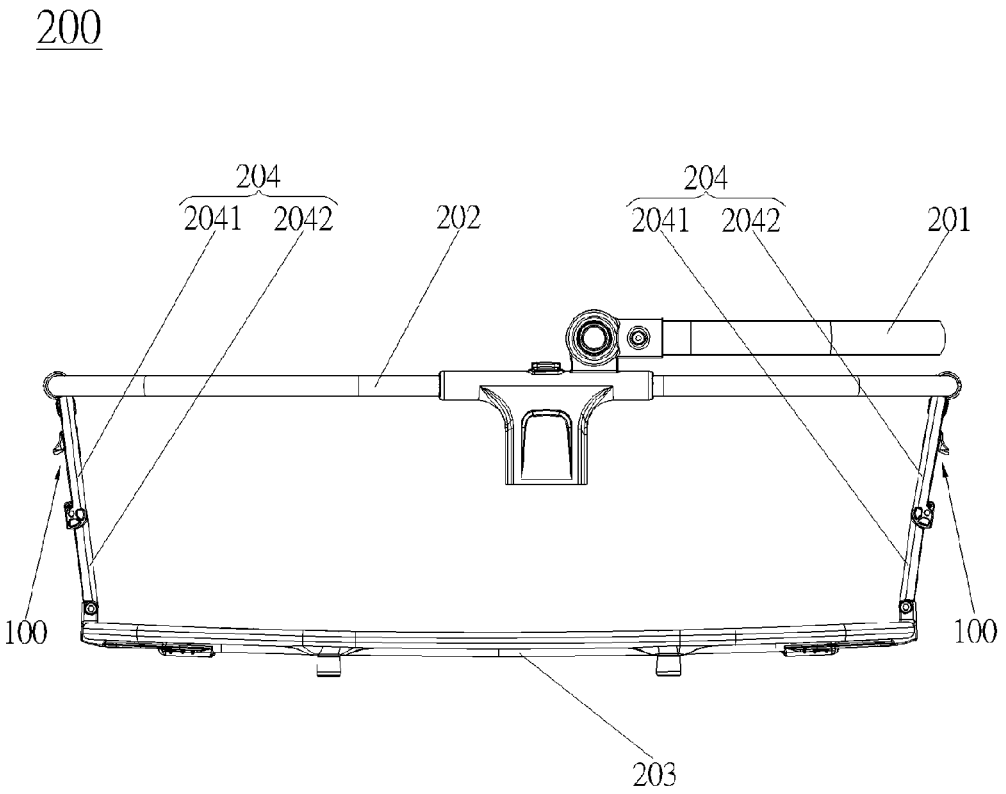
FIG. 1 is a schematic diagram of a foldable child carrier in an unfolded state according to an embodiment of the present application.
Figure 2:
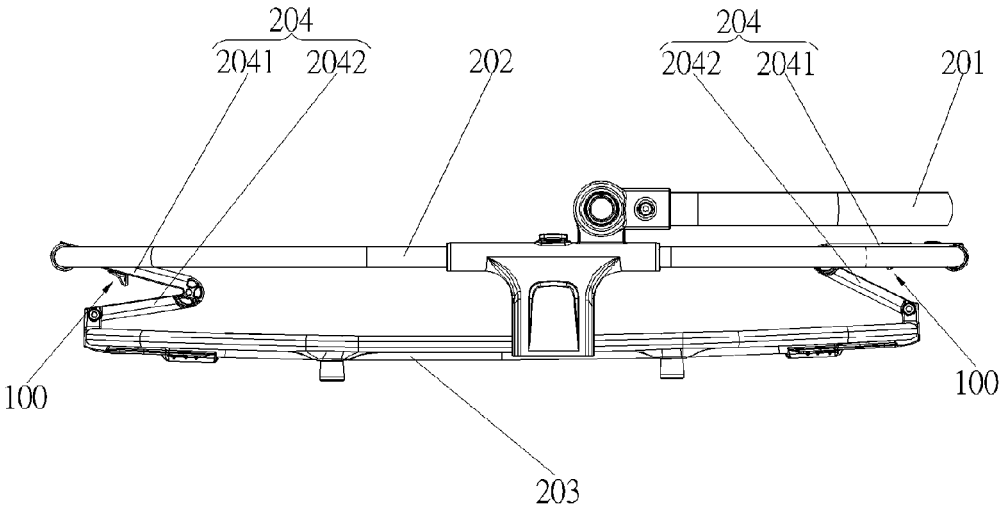
FIG. 2 is a schematic diagram of the foldable child carrier in a folded state according to the embodiment of the present application.
Figure 3:
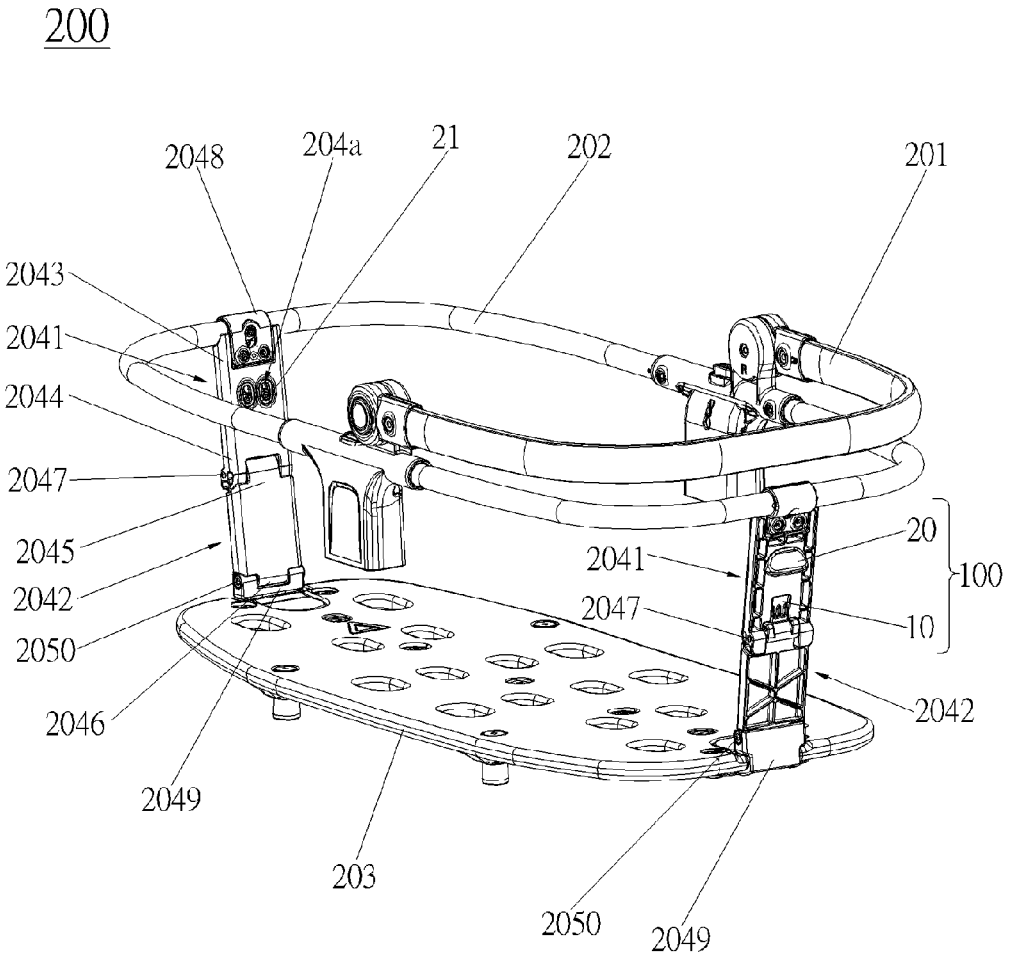
FIG. 3 is a schematic diagram of the foldable child carrier in the unfolded state at another view according to the embodiment of the present application.
Figure 4:
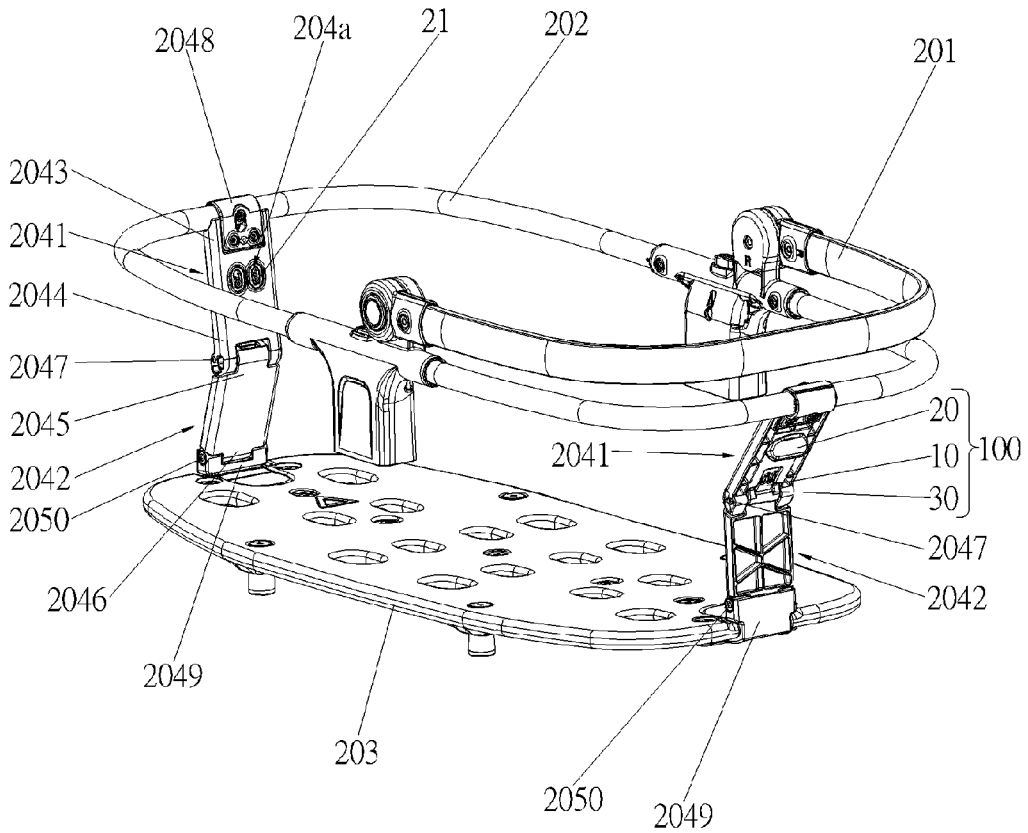
FIG. 4 is a schematic diagram of the foldable child carrier in a state between the folded state and the unfolded state according to the embodiment of the present application.

Please refer to FIG. 1 to FIG. 4. FIG. 1 is a schematic diagram of a foldable child carrier 200 in an unfolded state according to an embodiment of the present application. FIG. 2 is a schematic diagram of the foldable child carrier 200 in a folded state according to the embodiment of the present application. FIG. 3 is a schematic diagram of the foldable child carrier 200 in the unfolded state at another view according to the embodiment of the present application. FIG. 4 is a schematic diagram of the foldable child carrier 200 in a state between the folded state and the unfolded state according to the embodiment of the present application. As shown in FIG. 1 to FIG. 2, in this embodiment, the foldable child carrier 200 can be a child bassinet. However, the present application is not limited to this embodiment. For example, in another embodiment, the foldable child carrier can be a child basket, a child cradle, a child crib or a child stroller. The foldable child carrier 20 includes a handle 201, an upper frame 202, a lower plate 203, two lateral supports 204 and two folding mechanisms 100. The handle 201 is pivotally connected to the upper frame 202. The two lateral supports 204 are located between and connected to the upper frame 201 and the lower plate 203. Each of the two folding mechanisms 100 is disposed on the corresponding lateral support 204 for allowing a folding operation of the corresponding lateral support 204 to switch the foldable child carrier 200 from the unfolded state to the folded state, i.e., to reduce a height of the foldable child carrier 200 for easy transportation and storage.

However, the present application is not limited to this embodiment. In another embodiment, the folding mechanism can be disposed on the lower plate or the upper frame to reduce a length or a width of the lower plate or a length or a width of the upper frame, so as to reduce a length or a width of the entire foldable child carrier for easy transportation and storage.

Specifically, the upper frame 202 is located above the lower plate 203, and the upper frame 202 and the lower plate 203 are arranged in parallel and spaced from each other. The two lateral supports 204 connect two opposite sides of the upper frame 202 to two opposite sides of the lower plate 203, respectively, so as to enclose a supporting space for accommodating a child by the upper frame 202, the lower plate and the two lateral supports 204. In another embodiment, the foldable child carrier can further include at least one clothing component or at least one cushion on at least one of the upper frame, the lower plate and the two lateral supports for improving the child's comfort. The two folding mechanisms 100 are disposed on the two lateral supports 204 respectively and symmetrical to each other, so as to fold or unfold the two lateral supports 204 synchronously to stably fold or unfold the entire foldable child carrier 200. Since the foldable child carrier 200 has symmetrical structure at two sides, detailed description for structure of the foldable child carrier 200 at one side is provided as follows for simplicity.

As shown in FIG. 1 to FIG. 4, the lateral support 204 includes a first supporting component 2041 and a second supporting component 2042 movably connected to the first supporting component 2041. In this embodiment, the first supporting component 2041 and the second supporting component 2042 can be rotatably connected to each other, and the lateral support 204 can be folded or unfolded by a relative rotating movement of the first supporting component 2041 and the second supporting component 2042. However, the present application is not limited to this embodiment. For example, in another embodiment, the first supporting component and the second supporting component can be slidably connected to each other, and the lateral support can be folded or unfolded by a relative sliding movement of the first supporting component and the second supporting component.

Furthermore, the folding mechanism 100 includes a driven component 10, an operating component 20 and a locking component 30 which are disposed on a connection of the first supporting component 2041 and the second supporting component 2042. The driven component 10 is linked to the operating component 20 and can be driven to move by the operating component 20. The driven component 10 is configured to detachably engage with the locking component 30. The operating component 20 can drive the driven component 10 to engage with or disengage from the locking component 30 when the operating component 20 is operated. The driven component 10 engages with the locking component 30 to restrain the relative movement of the first supporting component 2041 and the second supporting component 2042. The driven component 10 disengages from the locking component 30 to allow the relative movement of the first supporting component 2041 and the second supporting component 2042.

In this embodiment, the first supporting component 2041 and the second supporting component 2042 can be two plate-shaped structures pivotally connected to each other, and an occupied space of the lateral support 204 can be changed by the relative rotating movement of the first supporting component 2041 and the second supporting component 2042. However, the present application is not limited to this embodiment. For example, in another embodiment, the first supporting component and the second supporting component can be two cylindrical structures slidably sleeved with each other, and the lateral support can be folded or unfolded by a relative sliding movement of the first supporting component and the second supporting component.

Specifically, in this embodiment, the first supporting component 2041 includes a first connecting portion 2043 and a first pivoting portion 2044. The second supporting component 2042 includes a second connecting portion 2046 and a second pivoting portion 2045. The first connecting portion 2043 is rotatably connected to the upper frame 202. The first pivoting portion 2044 and the second pivoting portion 2045 are pivotally connected to each other by a first pivoting shaft 2047. The second connecting portion 2046 is rotatably connected to the lower plate 203.

More specifically, the first supporting component 2041 includes an accommodating chamber **204*b* arranged along a longitudinal direction of the first supporting component 2041 and located between the first connecting portion 2043 and the first pivoting portion 2044. The driven component 10 is inserted into the accommodating chamber 204*b* in a loose-fitting manner. A portion of the operating component 20 extends along a traverse direction of the first supporting component 2041 from a side of the first supporting component 2041 and passes through the driven component 10 to slidably engage with an inserting hole 204*a* on another side of the first supporting component 2041. The locking component 30 is disposed on a top end of the second supporting component 2042 and for detachably engaging with the driven component 10**.

In order to connect the lateral support 204 to the upper frame 202 and the lower plate 203, the lateral support 204 further includes a first connecting component 2048 and a second connecting component 2049. An end of the first connecting component 2048 is rotatably sleeved on the upper frame 202. Another end of the first connecting component 2048 is fixedly connected to the first connecting portion 2043. An end of the second connecting component 2049 is fixedly connected to the lower plate 203. Another end of the second connecting component 2049 is pivotally connected to the second connecting portion 2046 by a second pivoting shaft 2050.

Figure 5:
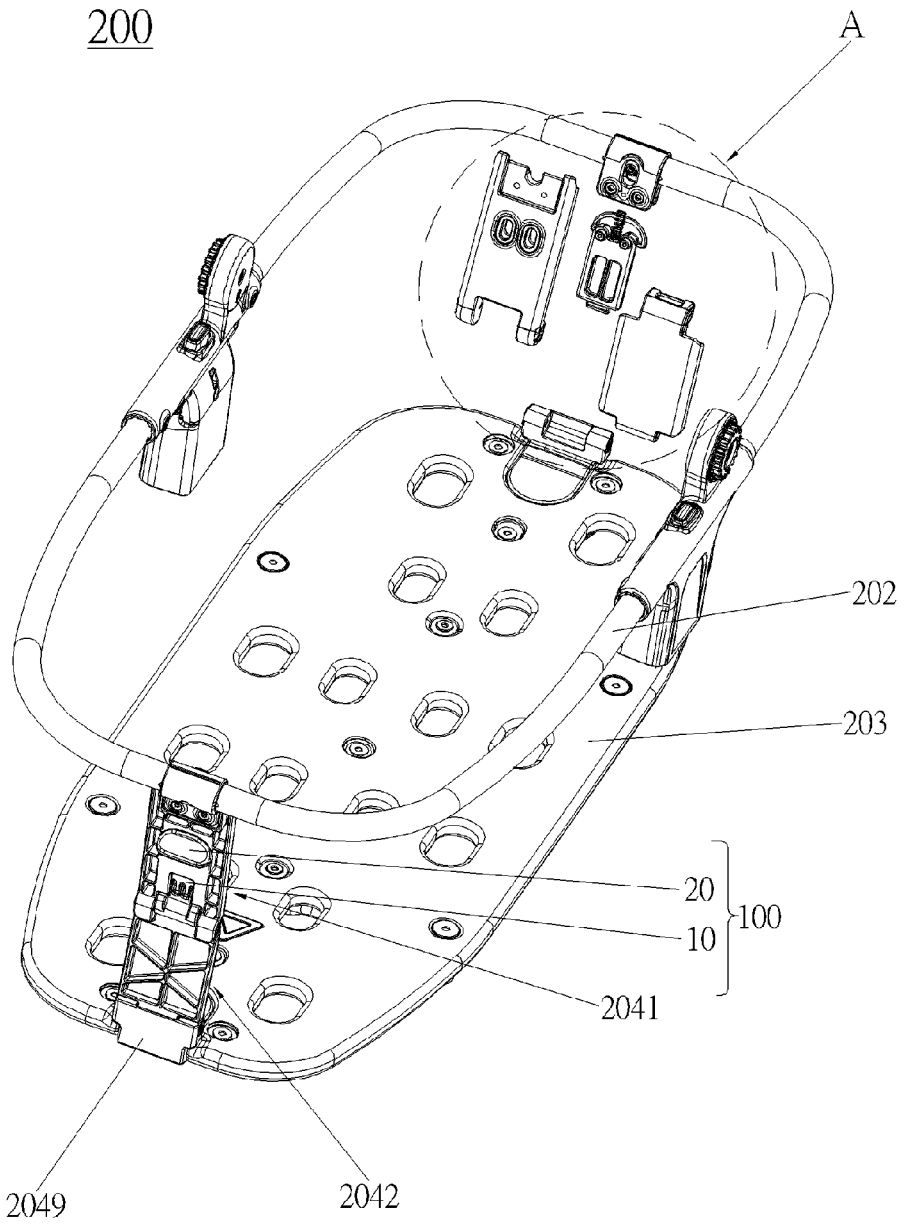
FIG. 5 is a partial exploded diagram of the foldable child carrier according to the embodiment of the present application.
Figure 6:
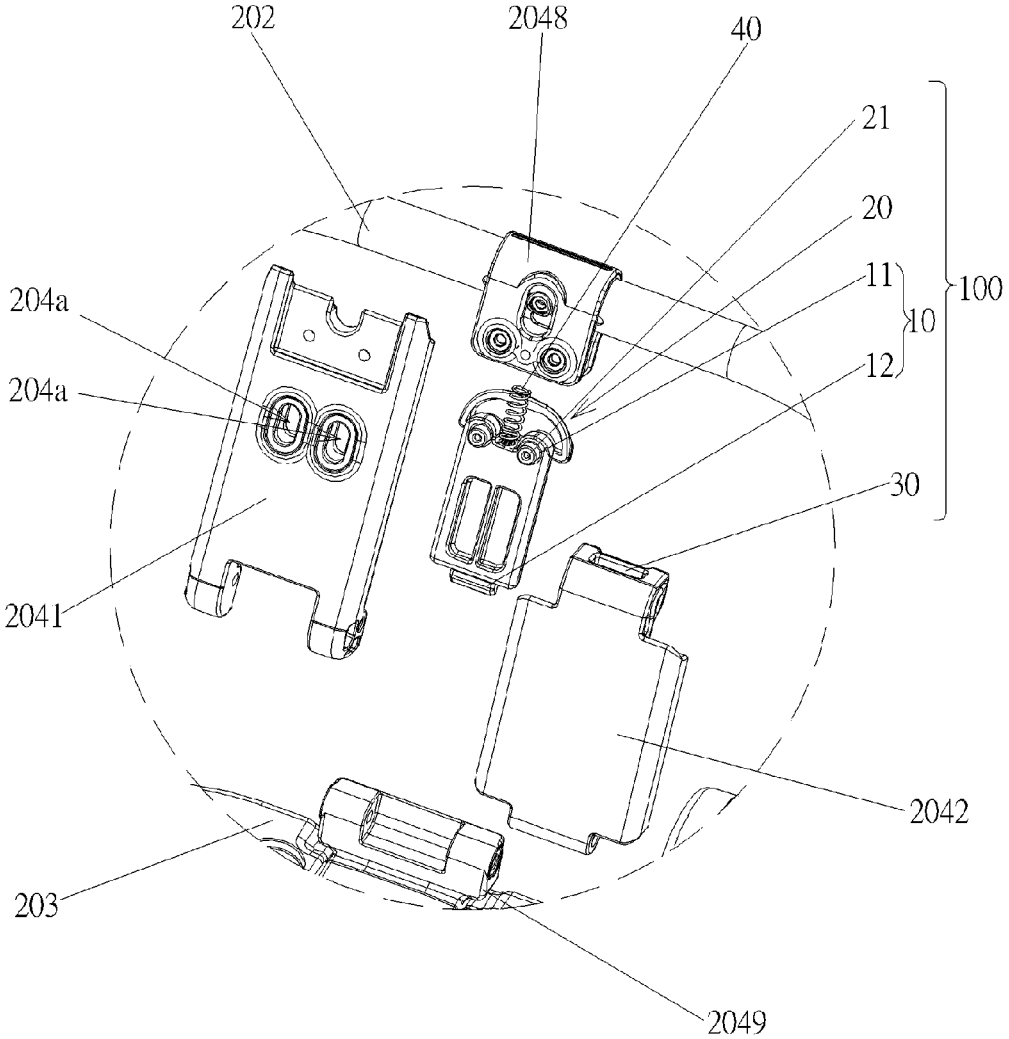
FIG. 6 is an enlarged diagram of an A portion of the foldable child carrier shown in FIG. 5 according to the embodiment of the present application.
Figure 7:
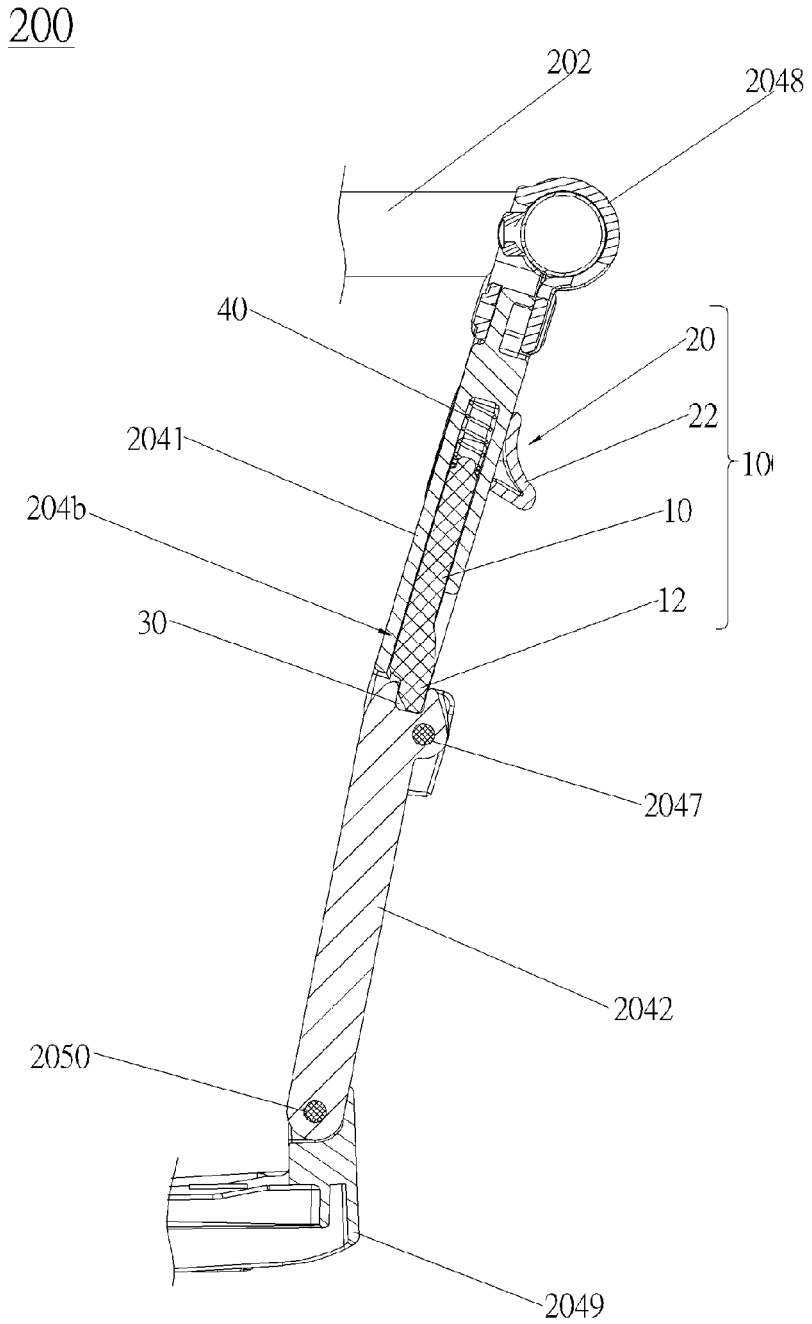
FIG. 7 is a partial sectional diagram of the foldable child carrier according to the embodiment of the present application.

Please refer to FIG. 5 to FIG. 7. FIG. 5 is a partial exploded diagram of the foldable child carrier 200 according to the embodiment of the present application. FIG. 6 is an enlarged diagram of an A portion of the foldable child carrier 200 shown in FIG. 5 according to the embodiment of the present application. FIG. 7 is a partial sectional diagram of the foldable child carrier 200 according to the embodiment of the present application. As shown in FIG. 5 to FIG. 7, in this embodiment, the driven component 10 and the operation 20 can be movably installed on the connection of the first supporting component 2041 and the second supporting component 2042. The locking component 30 is fixed on the connection of the first supporting component 2041 and the second supporting component 2042.

Specifically, the driven component 10 and the operating component 20 are slidably installed on the first supporting component 2041 along the longitudinal direction of the first supporting component 2041. The locking component 30 is fixed on the second supporting component 2042. An end of the driven component 10 is fixedly connected to the operating component 20. Another end of the driven component 10 is for detachably engaging with the locking component 30.

However, the present application is not limited to this embodiment. For example, in another embodiment, the driven component and the operating component can be slidably installed on the second supporting component along the longitudinal direction of the second supporting component, and the locking component is fixed on the first supporting component. Alternatively, in another embodiment, the driven component and the operating component can be installed on one of the first supporting component and the second supporting component in any other movable manner, e.g., in a rotatable manner, and the locking component is fixed on another one of the first supporting component and the second supporting component.

More specifically, the driven component 10 can be a plate-shaped structure. The operating component 20 can be a plug-shaped structure. The locking component 30 can be a restraining slot. Furthermore, an opening structure of the restraining slot can includes an arc-shaped guiding surface, and an engaging end of the driven component 10 for detachably engaging with the locking component 30 can includes another arc-shaped guiding surface. The two arc-shaped guiding surfaces can cooperate with each other to drive the driven component 10 to move away from the locking component 30 to prevent any interference caused by the driven component 10 during an unfolding operation of the foldable child carrier 200.

Besides, the driven component 10 includes a fixing portion 11 and a restraining portion 12 arranged along a longitudinal direction of the driven component 10 and located at two opposite ends of the driven component 10. The fixing portion 11 is fixedly connected to the operating component 20. The restraining portion 12 is for detachably engaging with the locking component 30 located at the top end of the second supporting component 2042. The fixing portion 11 can be at least one connecting hole on an upper end of the driven component 10. The restraining portion 12 can be at least one inserting block on a lower end of the driven component 10. A shape of the restraining portion 12 can match with a shape of the locking component 30. When the restraining portion 12 is inserted into the locking component 30, the first supporting component 2041 and the second supporting component 2042 are positioned to form a straight structure cooperatively to provide support for the upper frame 202 and the lower plate 203. When the restraining portion 12 is disengaged from the locking component 30, the first supporting component 2041 is allowed to rotate or pivot relative to the second supporting component 2042 around the first pivoting shaft 2047 to fold the foldable child carrier 200.

Moreover, the operating component 20 includes an inserting portion 21 and an operating portion 22 arranged along a traverse direction of the operating component 20 and located at two opposite sides of the operating component 20. The inserting portion 21 passes through the fixing portion 11 and slidably engages with the inserting hole **204*a* on the first supporting component 2041. The operating portion 22 slidably abuts against an outer wall of the first supporting component 2041 and protrudes from the outer wall of the first supporting component 2041. The operating portion 22 can be a pushing block slidably disposed on the outer wall of the first supporting component 2041. The inserting portion 21 can be at least one inserting column protruding away from the pushing block from a side of the pushing block attached on the first supporting component 2041. The at least one inserting column cooperates with the inserting hole 204*a*. The inserting hole 204*a* can be a long hole penetrating through two opposite lateral walls of the first supporting component 2041. An upper wall and a lower wall of the inserting hole 204*a* can stop a sliding movement of the inserting portion 21**.

Additionally, the folding mechanism 100 further includes a resilient component 40. The resilient component 40 is connected to and located between the first supporting component 2041 and the driven component 10 for driving the driven component 10 to engage with the locking component 30. The resilient component 40 can be a compression spring. However, the present application is not limited to this embodiment. For example, the resilient component can be connected to and located between the operating component and one of the first supporting component and the second supporting component where the driven component and the operating component are installed, so as to drive the operating component to drive the driven component to engage with the locking component.

When it is desired to fold the foldable child carrier 200, the operating component 20 can be pushed upwardly to drive the driven component 10 to slide upwardly for disengaging from the locking component 30 and to compress the resilient component 40, so that the first supporting component 2041 is allowed to rotate or pivot relative to the second supporting component 2042 to fold the foldable child carrier 200. When it is desired to unfold the foldable child carrier 20, the operating component 20 can be pushed upwardly to drive the driven component 10 to slide upwardly for preventing any interference caused by the driven component 10, and then the first supporting component 2041 can be rotated or pivoted relative to the second supporting component 2042 to unfold the foldable child carrier 200. When the foldable child carrier 200 is completely unfolded, the operating component 20 can be released to allow the resilient component 40 to drive the driven component 10 to slide downwardly to engage with the locking component 30 for positioning the foldable child carrier 200 in the unfolded state.

It should be noticed that in this embodiment, the driven component 10 and the locking component 30 includes the corresponding arc-shaped guiding surfaces, respectively. Therefore, the driven component 10 can be driven to move away from the locking component 20 and to compress the resilient component 40 by a cooperation of the corresponding arc-shaped guiding surfaces for preventing any interference during the unfolding operation of the foldable child carrier 200. Afterwards, the resilient component 40 can drive the driven component 10 to engage with the locking component 30 for positioning the foldable child carrier 200 in the unfolded state once the driven component 10 is aligned with the locking component 30. In other words, operation of the operating component 20 is not necessary during the unfolding operation of the foldable child carrier 200. Therefore, the present application is convenient in use.

In contrast to the prior art, in the present application, the operating component can drive the driven component to disengage from the locking component for allowing the relative movement of the first supporting component and the second supporting component or drive the driven component to engage with the locking component for restraining the relative movement of the first supporting component and the second supporting component. Therefore, the lateral support can be folded by the relative movement of the first supporting component and the second supporting component to fold the entire foldable child carrier to reduce an occupied space of the entire foldable child carrier for easy transportation and storage when the driven component is driven to disengage from the locking component. Furthermore, the relative movement of the first supporting component and the second supporting component can be restrained by engagement of the driven component and the locking component to prevent an accidental folding movement of the foldable child carrier, which improves safety in use. Besides, the present application has simple structure and easy operation.

Those skilled in the art will readily observe that numerous modifications and alterations of the device and method may be made while retaining the teachings of the application. Accordingly, the above disclosure should be construed as limited only by the metes and bounds of the appended claims.

What is claimed is:

1. A foldable child carrier comprising a lateral support, an upper frame, a lower plate and a folding mechanism, the lateral support being connected to and located between the lower plate and the upper frame, the lateral support comprising a first supporting component and a second supporting component movably connected to the first supporting component, the lateral support being folded or unfolded by a relative movement of the first supporting component and the second supporting component, wherein the folding mechanism comprises: a driven component; a locking component configured to engage with or disengage from the driven component; and an operating component linked to the driven component, the operating component driving the driven component to engage with the locking component for allowing the relative movement of the first supporting component and the second supporting component or driving the driven component to disengage from the locking component for restraining the relative movement of the first supporting component and the second supporting component, wherein the first supporting component comprises a first connecting portion, the second supporting component comprises a second connecting portion, the first connecting portion is rotatably connected and configured to selectively attach and detachably engage the first supporting component onto the upper frame, and the second connecting portion is rotatably connected and configured to selectively attach and detach the second supporting component onto the lower plate.

2. The foldable child carrier of claim 1, wherein the driven component and the operating component are movably installed on one of the first supporting component and the second supporting component, and the locking component is fixed on the other of the first supporting component and the second supporting component.

3. The foldable child carrier of claim 2, wherein an end of the driven component is fixedly connected to the operating component, and another end of the driven component is for detachably engaging with the locking component.

4. The foldable child carrier of claim 3, wherein the operating component and the driven component move along a longitudinal direction of the one of the first supporting component and the second supporting component.

5. The foldable child carrier of claim 3, wherein the driven component is a plate-shaped structure.

6. The foldable child carrier of claim 3, wherein the driven component comprises a fixing portion and a restraining portion, the fixing portion and the restraining portion are arranged along a longitudinal direction of the driven component and located at two opposite ends of the driven component, the fixing portion is fixedly connected to the operating component, and the restraining portion is for detachably engaging with the locking component.

7. The foldable child carrier of claim 6, wherein the fixing portion is at least one connecting hole on an upper end of the driven component, and the restraining portion is at least one inserting block on a lower end of the driven component.

8. The foldable child carrier of claim 3, wherein the operating component is a plug-shaped structure.

9. The foldable child carrier of claim 3, wherein the operating component comprises an inserting portion and operating portion, the inserting portion and the operating portion are arranged along a traverse direction of the operating component and located at two opposite sides of the operating component, the inserting portion passes through the driven component and slidably engages with an inserting hole on the first supporting component, and the operating portion slidably abuts against an outer wall of the first supporting component and protrudes from the outer wall of the first supporting component.

10. The foldable child carrier of claim 9, wherein the operating portion is a pushing block slidably disposed on the outer wall of the first supporting component, and the inserting portion is at least one inserting column protruding away from the pushing block from a side of the pushing block attached on the first supporting component.

11. The foldable child carrier of claim 9, wherein the inserting hole is a long hole penetrating through two opposite lateral walls of the first supporting component.

12. The foldable child carrier of claim 3, wherein the folding mechanism further comprises a resilient component connected to and located between the operating component and the one of the first supporting component and the second supporting component or connected to and located between the driven component and the one of the first supporting component and the second supporting component for driving the driven component to move toward the locking component to engage with the locking component.

13. The foldable child carrier of claim 1, wherein the locking component is a restraining slot.

14. The foldable child carrier of claim 13, wherein an opening structure of the restraining slot comprises an arc-shaped guiding surface.

15. The foldable child carrier of claim 1, wherein the first supporting component is rotatably or slidably connected to the second supporting component.

16. The foldable child carrier of claim 1, wherein the first supporting component comprises an accommodating chamber, the accommodating chamber is arranged along a longitudinal direction of the first supporting component, the driven component is inserted into the accommodating chamber, a portion of the operating component extends along a traverse direction of the first supporting component from a side of the first supporting component and passes through the driven component to slidably engage with an inserting hole on another side of the first supporting component, and the locking component is disposed on a top end of the second supporting component and for detachably engaging with the driven component.

17. The foldable child carrier of claim 1, wherein the first supporting component comprises a first pivoting portion, the second supporting component comprises a second pivoting portion, and the first pivoting portion is pivotally connected to the second pivoting portion by a first pivoting shaft.

18. The foldable child carrier of claim 17, wherein the first supporting component comprises an accommodating chamber, the accommodating chamber is arranged along a longitudinal direction of the first supporting component and located between the first connecting portion and the first pivoting portion, the driven component is inserted into the accommodating chamber, and a portion of the operating component extends along a traverse direction of the first supporting component from a side of the first supporting component and passes through the driven component to slidably engage with an inserting hole on another side of the first supporting component.

19. The foldable child carrier of claim 17, wherein the lateral support further comprises a first connecting component and a second connecting component, an end of the first connecting component is rotatably sleeved on the upper frame, another end of the first connecting component is fixedly connected to the first connecting portion, an end of the second connecting component is fixedly connected to the lower plate, and another end of the second connecting component is pivotally connected to the second connecting portion by a second pivoting shaft.

* * * * *